US006235461B1

(12) United States Patent
Sismondi et al.

(10) Patent No.: US 6,235,461 B1
(45) Date of Patent: May 22, 2001

(54) RADIOGRAPHIC ELEMENT HAVING IMPROVED SPEED TO DMIN RATIO AND MANUFACTURING PROCESS THEREOF

(75) Inventors: Alain Dominique M. Sismondi, Nice (FR); Marco Serafini, Ferrania (IT)

(73) Assignee: Tulalip Consultoria Comercial Sociedade Unipessoal S.A. (IT)

( * ) Notice: Subject to any disclaimer, the term of this patent is extended or adjusted under 35 U.S.C. 154(b) by 0 days.

(21) Appl. No.: 09/326,938

(22) Filed: Jun. 7, 1999

(30) Foreign Application Priority Data

Jun. 19, 1998 (EP) ..... 98111301

(51) Int. Cl.[7] ..... G03C 1/005; G03C 1/34

(52) U.S. Cl. ..... 430/569; 430/600; 430/607; 430/639

(58) Field of Search ..... 430/569, 639, 430/600, 607, 567

(56) References Cited

U.S. PATENT DOCUMENTS

| | | | | |
|---|---|---|---|---|
| 4,542,093 | * | 9/1985 | Suzuki et al. | 430/523 |
| 5,370,986 | * | 12/1994 | Lok et al. | 430/607 |
| 5,451,497 | * | 9/1995 | Miller et al. | 430/546 |
| 5,573,903 | * | 11/1996 | Yamashita et al. | 430/600 |
| 5,629,142 | * | 5/1997 | Maskasky | 430/502 |
| 5,985,530 | * | 11/1999 | Ishikawa et al. | 430/531 |
| 6,071,681 | * | 6/2000 | Morita et al. | 430/531 |

FOREIGN PATENT DOCUMENTS

| | | |
|---|---|---|
| 0114699 | 8/1984 | (EP) . |
| 0339870 | 11/1989 | (EP) . |
| 0452772 | 10/1991 | (EP) . |
| 0476521 | 3/1992 | (EP) . |
| 0482599 | 4/1992 | (EP) . |
| 0488029 | 6/1992 | (EP) . |
| 0903620 | 3/1999 | (EP) . |
| 55-098745 | 7/1980 | (JP) . |
| 55-098746 | 7/1980 | (JP) . |

* cited by examiner

*Primary Examiner*—Hoa Van Le
*Assistant Examiner*—Amanda C. Walke
(74) *Attorney, Agent, or Firm*—Mark A. Litman: Associates; Mark A. Litman

(57) ABSTRACT

The present invention relates to a process for manufacturing a silver halide photographic element comprising the step of adding to a silver halide emulsion (1) an aryl compound having at least two hydroxyl groups and at least one additional substituent represented by a sulfonic group, an alkali metal sulfonate group, a hydroxyl group, a carboxy group or a hydroxymethyl group, and (2) a polyhydroxyalkyl derivative selected from the group consisting of non-hydrogenated polysaccharides having an average molecular weight higher than 10,000 and hydrogenated polysaccharides having an average molecular weight equal to or lower than 10,000. The use of such a combination to increase the speed to Dmin ratio of a silver halide photographic element and a silver halide element comprising such a combination is also claimed.

11 Claims, No Drawings

RADIOGRAPHIC ELEMENT HAVING IMPROVED SPEED TO DMIN RATIO AND MANUFACTURING PROCESS THEREOF

FIELD OF THE INVENTION

The present invention relates to a silver halide radiographic element. More particularly, the present invention relates to a silver halide radiographic element having an improved speed to Dmin ratio comprising a polyhydroxyalkyl derivative and an aryl derivative, and to the manufacturing process thereof.

BACKGROUND OF THE INVENTION

Silver halide emulsions are typically prepared by precipitating silver halide (silver bromide, silver iodide, silver chloride or mixture thereof) in the presence of a hydrophilic colloid (normally gelatin). Silver halide emulsions are then typically subjected to a sensitization process for increasing their sensitivity to light. The sensitization process mainly involves spectral sensitization and chemical sensitization. Spectral sensitization includes the addition of spectral sensitizing dyes which can be adsorbed on the silver halide grain surface in order to make the emulsion sensitive to a particular wavelength radiation, such as visible or infrared radiation. Chemical sensitization includes the addition of various compounds to obtain a prescribed value of sensitivity and contrast. Typical methods for chemical sensitizing a silver halide photographic emulsion include sulfur sensitization, noble metal sensitization, and reduction sensitization. It is also common to have a combination of chemical sensitizing methods, such as sulfur-noble metal sensitization, reduction-noble metal sensitization, and the like, all which have been previously described. See, e.q., *Research Disclosure*, September 1994, Item 36544, Paragraph IV, pp. 510–511, which lists a wide array of references for each of the above-mentioned methods.

In recent years, there has been a strong demand for high sensitivity, low graininess and low fog in a silver halide photographic element as well as for rapid processing in which development is expedited. Various improvements in the above sensitizing methods have been made.

One approach focuses on the addition of coating aids. After the sensitization process, the silver halide emulsion is coated on a support together with coating additives. A description of useful coating aids can be found in Research Disclosure No. 38597, September 1996, "Photographic Silver Halide Emulsions, Preparations, Addenda, Systems and Processing", Item IX.

Useful coating aids including hydroxy-substituted aryl compounds are known. For example, U.S. Pat. No. 5,028,520 (Ito Tadashi, Silver Halide Photographic Material For X-Ray Use) describes the use of hydroquinone sulfonic acid potassium salt on tabular silver halide emulsion in an amount of from 0.03 to 0.5 moles per mole of silver to decrease the surface glossiness.

JP 54-040729, JP 56-001936 and JP 62-021143 describe the use of polyhydroxybenzene derivatives on cubic silver halide emulsions to decrease pressure sensitivity in graphic art films.

EP 452772, EP 476521, EP 482599 and EP 488029 describe the use of polyhydroxybenzene derivatives with functional groups that allow better silver halide grain adsorption to decrease pressure sensitivity of final film.

EP 339870 describes a silver halide photographic emulsion having in reactive association a sensitizing amount of polyalkylene glycol compound and a fog reducing amount of an arylhydroxy compound.

European Patent Application No. 97-116341.5 describes the use of aryl derivative in a process to prepare a silver halide emulsion to improve the speed to Dmin ratio of the resulting photographic elements.

Other useful known coating aids are olysaccharides. For example, U.S. Pat. No. 5,374,509 (Valentini Jose, Photographic Element Containing A Binder Composition For Improved Drying Characteristics) describes a mixture of hydrophilic colloid, a branched polysaccharide, a polyacrylamide, a polyvinylidine chloride and a polyacrylate in a quick water absorb and water release binder.

JP 8-0122956 describes a silver halide emulsion which contains a metal chelating agent (type tartaric acids, ethylene diamine tetraacetates, nitro triacetates, uramil diacetates) and a mono-, a di- or a polysaccharide. The silver halide emulsion has high sensitivity.

JP 55098745, JP 55098746, describes polysaccharides having glucose units as main chain, and mannose, fucose and glucoronic acids as side chain in photographic solution preparation for high speed coating and improved physical properties.

U.S. Pat. No. 5,370,986 (Lok et. al., Stabilization Of Photographic Recording Materials) describes the use of polyhydroxyalkyl stabilizer compounds and a co-stabilizing agent in silver chloride photographic element to prevent fog formation. The polyhydroxyalkyl stabilizer is a non-reducing oligosaccharide or its alkyl-substituted glycoside of formula R—$(CHOH)_n(CHOR1)_m$—Z with n=3–7, m=0–7, R=R1=H OR 1–3C alkyl, Z=COOR' or CONR'R' and R'=1–3C alkyl.

SUMMARY OF THE INVENTION

In one aspect of the present invention, a process for manufacturing a silver halide photographic element is provided. Preferably, the process includes the steps of: (i) preparing a silver halide emulsion, (ii) sensitizing said silver halide emulsion by means of a chemical and optical sensitization method, and (iii) coating said silver halide emulsion onto a support. A process of the present invention is characterized in that the process further includes a step of adding to the silver halide emulsion (1) an aryl compound having at least two hydroxyl groups and at least one additional substituent selected from the group consisting of a sulfonic group, an alkali metal sulfonate group, a hydroxyl group, a carboxy group, or a hydroxymethyl group, and (2) a polyhydroxyalkyl derivative selected from the group consisting of non-hydrogenated polysaccharides having an average molecular weight higher than 10,000 and hydrogenated polysaccharides having an average molecular weight equal to or lower than 10,000.

Preferably, the aryl compound is represented by the following formula:

(1)

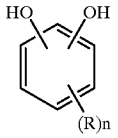

wherein R is a sulfonic group, an alkali metal sulfonate group, a hydroxyl group, a carboxy group, or a hydroxymethyl group, and n is an integer of from 1 to 4.

More preferably, the aryl compound is represented by the following formula:

(2)

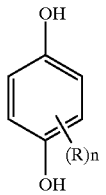

wherein R and n have the same meaning of formula (1) above.

Preferably, the non-hydrogenated polysaccharides have an average molecular weight higher than 15,000, and the hydrogenated polysaccharides have an average molecular weight lower than 8,000.

In accordance with the present invention, the aryl compound is preferably added in an amount less than 30 grams per mole of silver and the polyhydroxyalkyl derivative is added in an amount lower than 50 grams per mole of silver. More preferably, the aryl compound is added in an amount of from 2 to 8 grams per mole of silver and the polyhydroxyalkyl derivative is added in an amount of from 2 to 20 grams per mole of silver.

In another aspect of the present invention, a silver halide photographic element is provided. Preferably, the silver halide photographic element includes at least one silver halide emulsion layer coated on a support base, wherein said silver halide emulsion layer comprises a combination of (1) an aryl compound having at least two hydroxyl groups and at least one additional substituent represented by a sulfonic group, an alkali metal sulfonate group, a hydroxyl group, a carboxy group, or a hydroxymethyl group, and (2) a polyhydroxyalkyl derivative selected from the group consisting of non-hydrogenated polysaccharides having an average molecular weight higher than 10,000 and hydrogenated polysaccharides having an average molecular weight equal to or lower than 10,000.

In yet another embodiment, the present invention relates to the use of a combination of (1) an aryl compound having at least two hydroxyl groups and at least one additional substituent represented by a sulfonic group, an alkali metal sulfonate group, a hydroxyl group, a carboxy group, or a hydroxymethyl group, and (2) a polyhydroxyalkyl derivative selected from the group consisting of non-hydrogenated polysaccharides having an average molecular weight higher than 10,000 and hydrogenated polysaccharides having an average molecular weight equal to or lower than 10,000 to increase the speed to Dmin ratio of a light-sensitive silver halide element.

DETAILED DESCRIPTION OF THE INVENTION

The manufacturing process of silver halide elements usually comprises an emulsion-making step, a chemical and optical sensitization step, and a coating step. The silver halide emulsion-making step generally comprises a nucleation step, in which silver halide grain seeds are formed, followed by one or more growing steps, in which the grain seeds achieve their final dimension, and a washing step, in which all soluble salts are removed from the final emulsion. A ripening step is usually performed between the nucleation and growing step and/or between the growing and the washing steps. The resulting silver halide emulsion is then coated on a proper support to prepare a silver halide photographic element.

According to the method of the present invention, the polyhydroxyalkyl derivative and the aryl compound are added to the silver halide emulsion at any time before the coating of the silver halide emulsion. The term "any time before the coating" means during or after the emulsion-making step, before, during or after the chemical and optical sensitization step, or just before coating. According to a preferred embodiment of the process of the present invention, the polyhydroxyalkyl derivative and aryl compound combination is added just before coating.

Polysaccharides having a recurring unit comprising five or six carbon atoms are preferably used in the method of the present invention. Preferred recurring units include, for example, adonitol, arbitol, xylitol, dulcitol, iditol, mannitol, sorbitol, and the like. The average molecular weight of the non-hydrogenated polysaccharide derivatives used in the method of the present invention is higher than 10,000, preferably higher than 15,000, and most preferably in the range of from 15,000 to 30,000. The average molecular weight of the hydrogenated polysaccharide derivatives used in the method of the present invention is equal to or lower than 10,000, preferably lower than 8,000, and most preferably in the range of from 6,000 to 1,000.

Hydrogenated and non-hydrogenated polysaccharides are commercially available, for example, under the trade designation POLYSORB, from Roquette, Lille, France. The preparation of hydrogenated and non-hydrogenated polysaccharides usually starts from natural products (like starch, agar, tragacanth gum, xanthan gum, guar gum, and the like ) by means of enzymatic processes (to reduce the average molecular weight) and of reducing processes (to saturate the molecule, in case of hydrogenated polysaccharides).

For the purposes of the present invention, a polysaccharide described above is typically added in an amount less than 50 grams per mole of silver, preferably in the range of from 1 to 30 grams per mole of silver, more preferably from 2 to 20 grams per mole of silver. Such amounts can be expressed in terms of grams per square meter per side of the resulting silver halide radiographic element, wherein the amounts above correspond to an amount less than 2000, preferably in the range of from 40 to 1200, more preferably from 80 to 800 milligrams per square meter per side, respectively.

Preferably, the aryl compound is represented by the following formula:

(1)

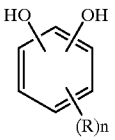

wherein R is a sulfonic group, an alkali metal sulfonate group, a hydroxyl group, a carboxy group, or a hydroxymethyl group, and n is an integer of from 1 to 4.

More preferably, the aryl compound is represented by the following formula:

(2)

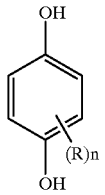

wherein R is a sulfonic group, an alkali metal sulfonate group, a hydroxyl group, a carboxy group, or a hydroxymethyl group, and n is an integer of from 1 to 4.

Useful examples of aryl compounds represented by the above mentioned general formulae are listed below.

A-1

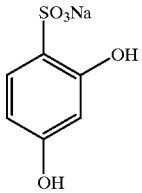

A-2

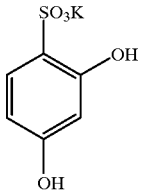

A-3

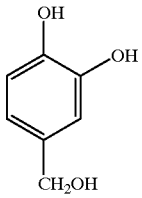

A-4

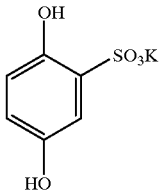

A-5

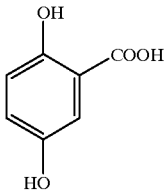

-continued

A-6

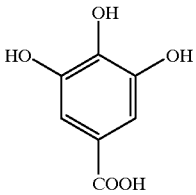

A-7

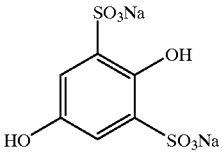

A-8

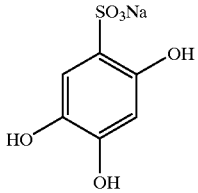

A-9

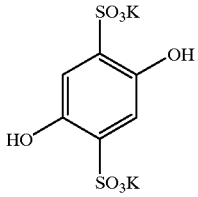

A-10

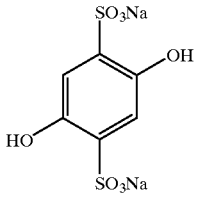

For the purposes of the present invention, an aryl compound, as described above, is typically added in an amount less than 20 grams per mole of silver, preferably in the range of from 1 to 10 grams per mole of silver, more preferably from 2 to 8 grams per mole of silver. These amounts can also be expressed in terms of grams per square meter per side of the resulting silver halide radiographic element, wherein these amounts correspond to an amount less than 800, preferably in the range of from 40 to 400, more preferably from 80 to 320 milligrams per square meter per side, respectively.

Silver halide emulsions useful in the present invention can be prepared using conventional methods, including a single-jet method, a double-jet method, or a combination of these methods and can be ripened using, for instance, an ammonia method, a neutralization method, or an acid method. Parameters which may be adjusted to control grain growth include pH, pAg, temperature, shape and size of reaction vessel, and the reaction method (e.g., accelerated or constant flow rate precipitation, interrupted precipitation, ultrafiltration during precipitation, reverse mixing processes and combinations thereof). A silver halide solvent, such as ammonia, thioethers, thioureas, etc., may be used, if desired, for controlling grain size, grain structure, particle size distribution of the grains, and the grain-growth rate. Methods for preparing silver halide emulsions are generally known to those skilled in the art and can be found in references such as Trivelli and Smith, *The Photographic Journal*, Vol. LXXIX, May 1939, pp. 330–338, T. H. James, *The Theory of The Photographic Process*, 4th Edition, Chapter 3, *Chimie et Physique Photographigue*, P. Glafkides, Paul Montel (1967), *Photographic Emulsion Chemistry*, G. F. Duffin, The Focal Press (1966), *Making and Coating Photographic Emulsions*, V. L. Zelikman, The Focal Press (1966), in U.S. Pat. Nos. 2,222,264; 2,592,250; 3,650,757; 3,917,485; 3,790,387; 3,716,276; and 3,979,213; and *Research Disclosure*, September 1994, Item 36544 "Photographic Silver Halide Emulsions, Preparations, Addenda, Systems and Processing."

In the preparation of silver halide emulsions, halogen compositions of the silver halide grains can be used. Typical silver halides include silver chloride, silver bromide, silver iodide, silver chloroiodide, silver bromoiodide, silver chlorobromoiodide and the like. However, silver bromide and silver bromoiodide are preferred silver halide compositions with silver bromoiodide compositions containing from 0 to 10 mol % silver iodide, preferably, from 0.2 to 5 mol % silver iodide, and more preferably, from 0.5 to 1.5 mol % silver iodide. The halogen composition of individual grains may be homogeneous or heterogeneous.

Silver halide emulsions typically include a binder material such as gelatin or other hydrophilic colloids, either alone or in combination, such as, dextran, cellulose derivatives (e.g., hydroxyethylcellulose, carboxymethyl cellulose), collagen derivatives, colloidal albumin or casein, polysaccharides, synthetic hydrophilic polymers (e.g., polyvinylpyrrolidone, polyacrylamide, polyvinylalcohol, polyvinylpyrazole) and the like. Preferred silver halide emulsions include gelatin or gelatin derivatives, such as highly deionized gelatin, acetylated gelatin and phthalated gelatin. The hydrophilic colloids may also be used in combination with synthetic polymeric binders and peptizers such as acrylamide and methacrylamide polymers, polymers of alkyl and sulfoalkyl acrylates and methacrylates, polyvinyl alcohol and its derivatives, polyvinyl lactams, polyamides, polyamines, polyvinyl acetates, and the like.

The silver halide grains of these emulsions may be coarse or fine, and the grain size distribution of them may be narrow or extensive. Further, the silver halide grains may be regular grains having a regular crystal structure such as cube, octahedron, and tetradecahedron, or the spherical or irregular crystal structure, or those having crystal defects such as twin planes, or those having a tabular form, or combination thereof. Furthermore, the grain structure of the silver halides may be uniform from the interior to exterior thereof, or be multilayer. In one embodiment, the grains may comprise a core and a shell, in which each may have different halide compositions and/or may have undergone different modifications such as the addition of doping agents. Besides having a differently composed core and shell, the silver halide grains may also comprise different phases in-between. Furthermore, the silver halides may be of such a type as allows a latent image to be formed mainly on the surface thereof or of such type as allows it to be formed inside the grains thereof.

In a preferred embodiment of the present invention, tabular silver halide emulsions are employed. Tabular silver halide emulsions are characterized by the average diameter:thickness ratio (i.e., aspect ratio) of silver halide grains. Tabular silver halide grains have an aspect ratio of at least 2:1, preferably, 2:1 to 20:1, more preferably, 2:1 to 14:1, and most preferably, 2:1 to 8:1. Average diameters of the tabular silver halide grains range from about 0.3 to about 5 mm, preferably, from about 0.5 to about 3 mm, more preferably, from about 0.8 to about 1.5 mm. The tabular silver halide grains have a thickness of less than 0.4 mm, preferably, less than 0.3 mm, and more preferably, within 0.1 to 0.3 mm. The projected area of the tabular silver halide grains accounts for at least 50%, preferably, at least 80%, and more preferably, at least 90% of the projected area of all the silver halide grains of the emulsion.

The tabular silver halide grain dimensions and characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain, a diameter:thickness ratio of each grain can be calculated, and the diameter:thickness ratios of all tabular grains can be averaged to obtain their average diameter:thickness ratio. In other words, the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the method used, the average diameter:thickness ratios obtained do not greatly differ.

Silver halide emulsions containing tabular silver halide grains can be prepared by various processes known to those of ordinary skill in the art for the preparation of photographic elements. For example, preparation of silver halide emulsions containing tabular silver halide grains is described in de Cugnac and Chateau, "Evolution of the Morphology of Silver Bromide Crystals During Physical Ripening", *Science and Industries Photographigues*, Vol. 33, No.2 (1962), pp.121–125, in Gutoff, "Nucleation and Growth Rates During the Precipitation of Silver Halide Photographic Emulsions", *Photographic Science and Engineering*, Vol. 14, No. 4 (1970), pp. 248–257, in Berry et al., "Effects of Environment on the Growth of Silver Bromide Microcrystals", Vol.5, No.6 (1961), pp. 332–336, in *Research Disclosure*, September 1994, Item 36544 "Photographic Silver Halide Emulsions, Preparations, Addenda, Systems and Processing", in U.S. Pat. Nos. 4,063,951; 4,067,739; 4,184,878; 4,434,226; 4,414,310; 4,386,156; and 4,414,306; and in EP Pat. Appln. No. 263,508.

At the end of the silver halide grain formation, water soluble salts are removed from the emulsion by procedures known in the art. Suitable washing processes are those wherein the dispersing medium and soluble salts dissolved therein can be removed from the silver halide emulsion on a continuous basis, such as, for example, a combination of dialysis or electrodialysis for the removal of soluble salts or a combination of osmosis or reverse osmosis for the removal of the dispersing medium.

Among the known techniques for removing the dispersing medium and soluble salts while retaining silver halide grains in the remaining dispersion, ultrafiltration is a particularly advantageous washing process. Typically, an ultrafiltration unit comprising membranes of inert, non-ionic polymers is used as a washing process. Since silver halide grains are large in comparison with the dispersing medium and the soluble salts or ions, silver halide grains are retained by the membranes while the dispersing medium and the soluble salts dissolved therein are removed.

Prior to use, silver halide grain emulsions are generally fully dispersed and bulked up with gelatin or other dispersion of peptizer and subjected to any of the known methods for achieving a desired sensitivity. A wide description of methods and compounds useful in chemical and optical sensitization can be found in Research Disclosure No. 38597, September 1996, "Photographic Silver Halide Emulsions, Preparations, Addenda, Systems and Processing", Items IV and 5.

Chemical sensitization is performed by adding chemical sensitizers and other additional compounds to the silver halide emulsion, followed by the so-called chemical ripening at high temperature for a predetermined period of time. Chemical sensitization can be performed by various chemical sensitizers such as gold, sulfur, reducing agents, platinum, selenium, sulfur plus gold, and the like. Tabular silver halide grains, after grain formation and desalting, are preferably chemically sensitized by at least one gold sensitizer and at least one sulfur sensitizer. During chemical sensitization, other compounds can be added to improve the photographic performances of the resulting silver halide emulsion, such as, for example, antifoggants, stabilizers, optical sensitizers, supersensitizers, and the like.

Gold sensitization is performed by adding a gold sensitizer to the emulsion and stirring the emulsion at high temperature of preferably 40° C. or more for a predetermined period of time. As a gold sensitizer, any gold compound which has an oxidation number of +1 or +3 and is normally used as gold sensitizer can be used. Preferred examples of gold sensitizers are chloroauric acid, the salts thereof, and gold complexes, such as those described in U.S. Pat. No. 2,399,083. Specific examples of gold sensitizers include chloroauric acid, potassium chloroaurate, auric trichloride, sodium aurithiosulfate, potassium aurithiocyanate, potassium iodoaurate, tetracyanoauric acid, 2-aurosulfobenzothiazole methochloride, and ammonium aurothiocyanate.

Sulfur sensitization is performed by adding a sulfur sensitizer to the silver halide emulsion and stirring the emulsion at a high temperature of 40° C. or more for a predetermined period of time. Useful examples of sulfur sensitizer include thiosulfonates, thiocyanates, sulfinates, thioethers, and elemental sulfur.

The amounts of the gold sensitizer and the sulfur sensitizer change in accordance with the various conditions, such as activity of the gold and sulfur sensitizer, type and size of silver halide grains, temperature, pH and time of chemical ripening. These amounts, however, are preferably from 1 to 20 mg of gold sensitizer per mole of silver, and from 1 to 100 mg of sulfur sensitizer per mole of silver. The temperature of chemical ripening is preferably 45° C. or more, and more preferably 50° C. to 80° C. The pAg and pH may take arbitrary values.

During chemical sensitization, addition times and order of gold sensitizer and sulfur sensitizer are not particularly limited. For example, gold and sulfur sensitizers can be added at the initial stage of chemical sensitization or at a later stage either simultaneously or at different times. Usually, gold and sulfur sensitizers are added to the silver halide emulsion by their solutions in water, in a water-miscible organic solvent, such as methanol, ethanol and acetone, or as a mixture thereof.

A stabilizer is preferably added at any time before the addition of the sulfur sensitizer. While not intending to be bound by any particular theory, it is believed that it acts as a digest stabilizer and a site director for the sulfur sensitizer. Preferably, the stabilizer is added before the addition of sulfur chemical sensitizer in an amount of from 1 to 500 milligrams per mole of silver, preferably, from 10 to 300 milligrams per mole of silver. Specific examples of useful stabilizers include thiazole derivatives; benzothiazole derivatives; mercapto-substituted heterocyclic compounds (e.g., mercaptotetrazoles, mercaptotriazoles, mercaptodiazoles, mercaptopyrimidines, mercaptoazoles); azaindenes (e.g., triazaindenes and tetrazaindenes); triazoles; tetrazoles; and sulfonic and sulfinic benzene derivatives. Azaindenes are preferably used, more preferably, tetraazaindenes.

A silver halide grain emulsion may be optically sensitized to a desired region of the visible spectrum. Suitable methods for spectral sensitization are known. For example, optical sensitization may be achieved by using an optical sensitizer, such as a cyanine dye, a merocyanine dye, complex cyanine and a merocyanine dye, an oxonol dye, a hemioxonol dye, a styryl dye and a streptocyanine dye, or a combination thereof. Useful optical sensitizers include cyanines derived from quinoline, pyridine, isoquinoline, benzindole, oxazole, thiazole, selenazole, imidazole. Particularly useful optical sensitizers are the dyes of the benzoxazole-, benzimidazole- and benzothiazole-carbocyanine type. Typically, the addition of the spectral sensitizer is performed after the completion of chemical sensitization. Alternatively, spectral sensitization can be performed concurrently with chemical sensitization, before chemical sensitization, or even prior to the completion of silver halide precipitation. When the spectral sensitization is performed before the chemical sensitization, it is believed that the preferential absorption of spectral sensitizing dyes on the crystallographic faces of the tabular grains allows chemical sensitization to occur selectively at unlike crystallographic surfaces of the tabular grains. In a preferred embodiment, the spectral sensitizers produce J aggregates, if adsorbed on the surface of the silver halide grains, and a sharp absorption band (J-band) with a bathochromic shift with respect to the absorption maximum of the free dye in aqueous solution.

It is known in the art of radiographic photographic elements that the intensity of the sharp absorption band (J-band) shown by the spectral sensitizing dye absorbed on the surface of the light-sensitive silver halide grains will vary with the quantity of the specific dye chosen as well as the size and chemical composition of the grains. The maximum intensity of J-band has been obtained with silver halide grains having the above described sizes and the chemical compositions absorbed with J-band spectral sensitizing dyes in a concentration of from 25 to 100 percent or more of monolayer coverage of the total available surface area of the silver halide grains. Optimum dye concentration levels can be chosen in the range of 0.5 to 20 millimoles per mole of silver halide, preferably, in the range of 2 to 10 millimoles.

Spectral sensitizing dyes producing J aggregates are known in the art, such as described by F. M. Hamer, *Cyanine Dyes and Related Compounds*, John Wiley and Sons, 1964, Chapter XVII and by T. H. James, *The Theory of the Photographic Process*, 4th Edition, MacMillan, 1977, Chapter 8.

In a preferred form, J-band exhibiting dyes are cyanine dyes. Such dyes comprise two basic heterocyclic nuclei joined by a linkage of methine groups. The heterocyclic nuclei preferably include fused benzene rings to enhance J aggregation. The heterocyclic nuclei are preferably quinolinium, benzoxazolium, benzothiazolium, benzoselenazolium, benzimidazolium, naphthoxazolium, naphthothiazolium and naphthoselenazolium quaternary salts.

Suitable cyanine dyes, which are joined by a methine linkage, include two basic heterocyclic nuclei, such as pyrrolidine, oxazoline, thiazoline, pyrrole, oxazole, thiazole, selenazole, tetrazole and pyridine and nuclei obtained by fusing an alicyclic hydrocarbon ring or an aromatic hydrocarbon ring to each of the above nuclei, such as indolenine, benzindolenine, indole, benzoxazole, naphthoxazole, benzothiazole, naphthothiazole, benzoselenazole, benzimidazole and quinoline. These nuclei can have substituent groups.

Suitable merocyanine dyes, which are joined by a methine linkage, include a basic heterocyclic nucleus of the type described above and an acid nucleus, such as a 5- or 6-membered heterocyclic nucleus derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1-3-dione, and isoquinolin-4-one.

Preferred dyes are cyanine dyes, such as those represented by the following formula:

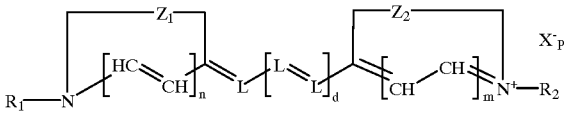

wherein n, m and d each independently represents 0 or 1, L represents a methine linkage, e.g., =CH—, =C($C_2H_5$)—, etc., $R_1$ and $R_2$ each represents a substituted or unsubstituted alkyl group, preferably, a lower alkyl group of from 1 to 4 carbon atoms, e.g., methyl, ethyl, propyl, butyl, cyclohexyl and dodecyl, a hydroxyalkyl group, e.g., b-hydroxyethyl and W-hydroxybutyl, an alkoxyalkyl group, e.g., b-methoxyethyl and W-butoxyethyl, a carboxyalkyl group, e.g., b-carboxyethyl and W-carboxybutyl, a sulfoalkyl group, e.g., b-sulfoethyl and W-sulfobutyl, a sulfatoalkyl group, e.g., b-sulfatoethyl and W-sulfatobutyl, an acyloxyalkyl group, e.g., b-acetoxyethyl, g-acetoxypropyl and W-butyryloxybutyl, an alkoxycarbonylalkyl group, e.g., b-methoxycarbonylethyl and W-ethoxycarbonylbutyl, benzyl, phenethyl, or an aryl group of up to 30 carbon atoms, e.g., phenyl, tolyl, xylyl, chlorophenyl and naphthyl, X represents an acid anion, e.g., chloride, bromide, iodide, thiocyanate, sulfate, perchlorate, p-toluenesulfonate and methylsulfate; the methine linkage forming an intramolecular salt when p is 0; $Z_1$ and $Z_2$, the same or different, each represents the non-metallic atoms necessary to complete the same simple or condensed 5- or 6-membered heterocyclic nucleus, such as a benzothiazole nucleus (e.g., benzothiazole, 3-, 5-, 6- or 7-chloro-benzothiazole, 4-, 5- or 6-methylbenzothiazole, 5- or 6-bromobenzothiazole, 4- or 5-phenyl-benzothiazole, 4-, 5- or 6-methoxybenzothiazole, 5,6-dimethyl-benzothiazole and 5- or 6-hydroxybenzothiazole), a naphthothiazole nucleus (e.g., a-naphthothiazole, b-naphthothiazole, 5-methoxy-b-naphthothiazole, 5-ethoxy-a-naphthothiazole and 8-methoxy-a-naphthothiazole), a benzoselenazole nucleus (e.g., benzoselenazole, 5-chloro-benzoselenazole and tetrahydrobenzoselenazole), a naphthoselenazole nucleus (e.g., a-naphtho-selenazole and b-naphthoselenazole), a benzoxazole nucleus (e.g., benzoxazole, 5- or 6-hydroxybenzoxazole, 5-chloro-benzoxazole, 5- or 6-methoxybenzoxazole, 5-phenyl-benzoxazole and 5,6-dimethylbenzoxazole), a naphthoxazole nucleus (e.g., a-naphthoxazole and b-naphthoxazole), a 2-quinoline nucleus (e.g., 2-quinoline, 6-, 7, or 8-methyl-2-quinoline, 4-, 6- or 8-chloro-2-quinoline, 5-, 6- or 7-ethoxy-2-quinoline and 6- or 7-hydroxy-2-quinoline), a 4-quinoline nucleus (e.g., 4-quinoline, 7- or 8-methyl-4-quinoline and 6-methoxy-4-quinoline), a benzimidazole nucleus (e.g., benzimidazole, 5-chloro-benzimidazole and 5,6-dichlorobenzimidazole), a thiazole nucleus (e.g., 4- or 5-methylthiazole, 5-phenyl-thiazole and 4,5-di-methyl-thiazole), an oxazole nucleus (e.g., 4- or 5-methyl-oxazole, 4-phenyl-oxazole, 4-ethyl-oxazole and 4,5-dimethyl-oxazole), and a selenazole nucleus (e.g., 4-methyl-selenazole and 4-phenyl-selenazole. More preferred dyes within the above class are those having an internal salt group and/or derived from benzoxazole and benzimidazole nuclei as indicated before. Typical methine spectral sensitizing dyes include those listed below.

Dye A

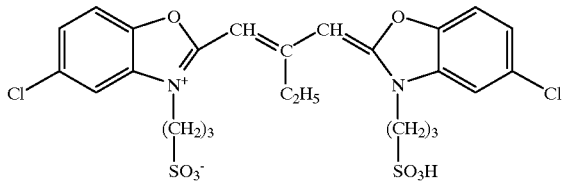

Dye B

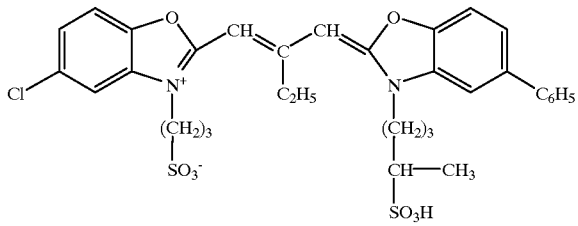

Dye C

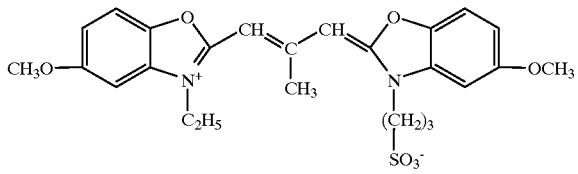

Dye D

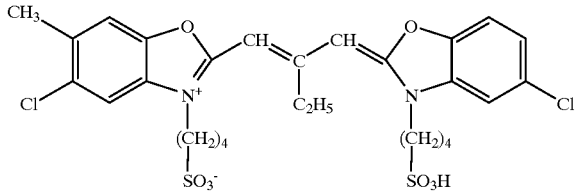

Dye E

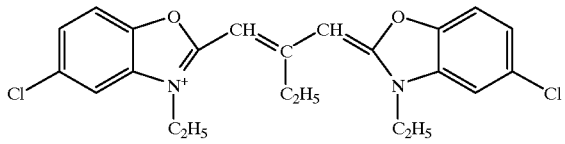

-continued

Dye F

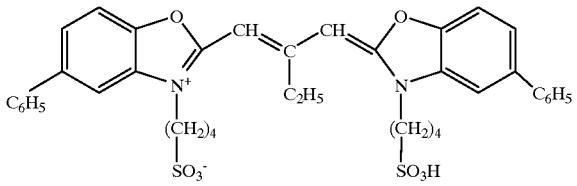

Dye G

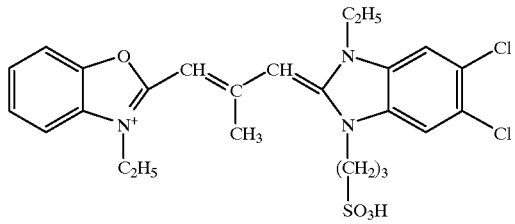

The methine spectral sensitizing dyes are generally known in the art, such as those described in U.S. Pat. Nos. 2,503,776; 2,912,329; 3,148,187; 3,397,060; 3,573,916; and 3,822,136 and FR Pat. No. 1,118,778. Also their use in photographic emulsions is known, wherein they are used in optimum concentrations corresponding to desired values of sensitivity to fog ratios. Optimum or near optimum concentrations of spectral sensitizing dyes generally go from 10 to 500 mg per mole of silver, preferably, from 50 to 200, and more preferably, from 50 to 100.

Spectral sensitizing dyes can be used in combinations which result in supersensitization, i.e., spectral sensitization which is greater in a spectral region than that from any concentration of one dye alone or which would result from an additive effect of the dyes. Supersensitization can be obtained with selected combinations of spectral sensitizing dyes and other addenda, such as stabilizers and antifoggants, development accelerators and inhibitors, optical brighteners, surfactants and antistatic agents, as described by Gilman, *Photographic Science and Engineering*, 18, pp. 418–430, 1974 and in U.S. Pat. Nos. 2,933,390; 3,635,721; 3,743,510; 3,615,613; 3,615,641; 3,617,295; and 3,635,721.

Other additives can be added to the silver halide emulsion before or during coating, such as, stabilizers or antifoggants (i.e., azaindenes, triazoles, tetrazoles, imidazolium salts, polyhydroxy compounds and others); developing promoters (e.g., benzyl alcohol, polyoxyethylene type compounds, etc.); image stabilizers (i.e., compounds of the chromane, cumaran, bisphenol type, etc.); and lubricants (i.e., wax, higher fatty acids glycerides, higher alcohol esters of higher fatty acids, etc.). Also, coating aids, modifiers of the permeability in the processing liquids, defoaming agents, antistatic agents and matting agents may be used. Other useful additives are disclosed in *Research Disclosure*, Item 17643, December 1978 in *Research Disclosure*, Item 18431, August 1979, in *Research Disclosure*, Item 308119, Section IV, December 1989, and in *Research Disclosure*, Item 36544, September 1994.

A silver halide emulsion is then coated on a support. Suitable supports include glass, paper, polyethylene-coated paper, metals, polymeric film such as cellulose nitrate, cellulose acetate, polystyrene, polyethylene terephthalate, polyethylene, polypropylene and the like. A preferred support is polyethylene terephthalate.

Preferred light-sensitive silver halide photographic elements are radio-graphic light-sensitive elements employed in X-ray imaging comprising a silver halide emulsion layer (s) coated on both surfaces of a support. The silver halide emulsions are preferably coated on the support at a silver coverage in the range of 1.5 to 3 g/m$^2$ per side.

Usually, the radiographic light-sensitive elements are associated with intensifying screens so as to be exposed to radiation emitted by the screens. Preferable intensifying screens are made of relatively thick phosphor layers which transform the X-rays into more imaging-effective radiation such as light (e.g., visible light). In operation, the screens absorb a larger portion of X-rays than the light-sensitive elements do and are used to reduce the X-ray dose necessary to obtain a useful image. Intensifying screens absorbing more than 25% of the total X-radiation are preferably used. Depending on their chemical composition, the phosphors can emit radiation in the ultraviolet, blue, green or red region of the visible spectrum and the silver halide emulsions are sensitized to the wavelength region of the radiation emitted by the screens. Sensitization is performed by using spectral sensitizing dyes absorbed on the surface of the silver halide grains as described above.

Radiographic elements of the present invention can include other layers and additives, such as subbing layers, surfactants, filter dyes, intermediate layers, protective layers, anti-halation layers, barrier layers, dye underlayers, development inhibiting compounds, speed-increasing agents, stabilizers, plasticizers, chemical sensitizers, UV absorbers and the like can be present in the radiographic element. Dye underlayers are particularly useful to reduce the cross-over of the double coated silver halide radiographic element. Reference to well-known dye underlayer can be found in U.S. Pat. Nos. 4,900,652; 4,855,221; 4,857,446; and 4,803,150. In a preferred embodiment, a dye underlayer is coated on at least one side of the support, more preferably, on both sides of the support, before the coating of at least two silver halide emulsion.

The silver halide radiographic elements are preferably fore-hardened. Typical examples of organic or inorganic hardeners include chrome salts (e.g., chrome alum, chromium acetate), aldehydes (e.g., formaldehyde and glutaraldehyde), isocyanate compounds (hexamethylene diisocyanate), active halogen compounds (e.g., 2,4-dichloro-6-hydroxy-s-triazine), epoxy compounds (e.g., tetramethylene glycol diglycidylether), N-methylol derivatives (e.g., dimethylolurea, methyloldimethyl hydantoin), aziridines, mucohalogeno acids (e.g., mucochloric acid), active vinyl derivatives (e.g., vinylsulfonyl and hydroxy-substituted vinylsulfonyl derivatives) and the like. Other references to well known hardeners can be found in *Research Disclosure*, December 1989, Vol. 308, Item 308119, Section X, and *Research Disclosure*, September 1994, Vol. 365, Item 36544, Section II(b).

A detailed description of photographic elements and of various layers and additives can be found in *Research Disclosure* 17643 December 1978, *Research Disclosure* 18431 August 1979, *Research Disclosure* 18716 November 1979, *Research Disclosure* 22534 January 1983, *Research Disclosure* 308119 December 1989, and *Research Disclosure* 36544, September, 1994.

The silver halide photographic element can be exposed and processed by any conventional processing technique. Any known developing agent can be added into the developer, such as dihydroxybenzenes (e.g., hydroquinone), pyrazolidones (1-phenyl-3-pyrazolidone or 4,4-dimethyl-1-phenyl-3-pyrazolidone), and aminophenols (e.g., N-methyl-p-aminophenol), alone or in combinations thereof. Preferably, the silver halide photographic elements are developed in a developer comprising dihydroxybenzenes as the main developing agent, and pyrazolidones and p-aminophenols as auxiliary developing agents.

Other known additives can be present in the developer, such as, for example, antifoggants (e.g., benzotriazoles, indazoles, tetrazoles), silver halide solvents (e.g., thiosulfates, thiocyanates), sequestering agents (e.g., aminopolycarboxylic acids, aminopolyphosphonic acids), sulfite antioxidants, buffers, restrainers, hardeners, contrast promoting agents, surfactants, and the like. Inorganic alkaline agents, such as KOH, NaOH, and LiOH are added to the developer composition to obtain the desired pH which is usually higher than 10.

The silver halide photographic element can be processed with a fixer of a typical composition for the application required. The fixing agents include thiosulfates, thiocyanates, sulfites, ammonium salts, and the like. The fixer composition can comprise other well known additives, such as acid compounds (e.g., metabisulfates), buffers (e.g., carbonic acid, acetic acid), hardeners (e.g., aluminum salts), tone improving agents, and the like.

The exposed radiographic elements can be processed by any of the conventional processing techniques. Such processing techniques are illustrated for example in *Research Disclosure*, Item 17643, cited above, and *Research Disclosure* 36544 September 1994. Roller transport processing is particularly preferred, as illustrated in U.S. Pat. Nos. 3,025,779; 3,515,556; 3,545,971; and 3,647,459, and in UK Patent 1,269,268. Hardening development can be undertaken, as illustrated in U.S. Pat. No. 3,232,761.

Further details with regard to the processes for the silver halide emulsion preparation and the use of particular ingredients in the emulsion and in the light-sensitive element can be found in *Research Disclosure*, September 1996, Item 38957.

EXAMPLES

The following non-limiting examples will further illustrate the invention. All parts, percentages, ratios, etc., in the examples are by weight unless otherwise indicated.

Comparative Example A

A silver bromoiodide emulsion was prepared using a conventional double jet method for Comparative Examples A–G and Examples 1–3, below. The resulting emulsion had an average grain equivalent diameter of 1.35 micron, an average grain thickness of 0.22 micron, a coefficient of variation (COV) of 40% and 0.9 percent iodide in mole respect to the total halide ions. The COV is a coefficient indicating the grain size distribution width and can be defined by the following formula:

$$COV = \frac{\text{Grain Standard Deviation}}{\text{Average Grain Diameter}} \cdot 100$$

The emulsion was chemically and spectrally sensitized using conventional sulfur, gold, mercury and palladium sensitizers plus a triethyl ammonium salt of 5,5'-dichloro-9-ethyl-3,3'-di-(3-sulfopropyl) oxacarbocyanine as spectral sensitization dye. The digest was performed for about 120 to 130 minutes at 600 and stabilized successively with 200 mg of potassium iodide and 1366 mg of 5-methyl-7-hydroxy-2-3-4-triazoindolizine (4-hydroxy-6-methyl-1,3,3a,7-tetraazaindene) before chilling and kept in cold storage until needed for coating.

The sensitized silver halide emulsion was melted at 45° C. and subjected to coating finals. As coating auxiliaries were added 1293 mg of calcium nitrate, 80 mg of azodicarboxylic dimorpholide, 18338 mg of polyethylacrylate (in dispersion at 20% in water plus 367 mg of lauryl sulfate), 66738 mg of dextran as gel extender, 267 mg of colanyl blue as chromatic corrector. The pH was corrected to 6.3 before adding 3774 mg of SSMA copolymer (copolymer of styrene sulfonic acid and maleic anhydride).

The resulting silver halide emulsion was immediately coated on the two faces of blue 7 mil polyester base with a conventional antistatic top-coat containing surfactants (Niaproof, the trade name of an anionic surfactant of the alkane sulfate type, Zonyl FS300, the trade name of a non-ionic perfluoroalkylpolyoxyethylene surfactant, and lauric acid diethanolamide), hardening agents (1,3-bisvinylsulfonyl-2-propanol), and matting agents (polymethylmethacrylate particles) dispersed in gelatin. The coating speed was 8.3 meters per minute and the covering weight was around 2.125 g of silver per $m^2$ per side.

The fresh film samples were kept 3 days at 38° C. before being subjected to X-ray exposure using an X-ray tube at 75 Kilovolt and 300 Milliampere for 0.06 second with two screens commercially available under the trade designation TRIMAX T8 manufactured by Imation Corp., Oakdale, Minn., USA.

The exposed films were processed through a 90 second dry to dry medical X-ray automatic processor type XP-515 (manufactured by Imation Corp., MN, USA) with commercially available chemistry (XAD 3 developer and XAF 3 fixer, both from Imation Corp., Oakdale, Minn., USA).

The sensitometric results are reported in Table 1 below.

Comparative Example B

The procedure of Comparative Example A was repeated, except that during addition of coating finals, 6.32 grams of a hydrogenated polysaccharide commercially available under the trade designation POLYSORB, from Roquette Freres, Lille, France (abbreviated hereinafter as "HP"), was added per one mole of silver, corresponding to 249 mg of compound per square meter of coated film.

The sensitometric results are reported in Table 1.

Comparative Example C

The procedure of Comparative Example A was repeated, except that during addition of coating finals, 13.44 grams of HP was added per one mole of silver, corresponding to 529 mg of compound per square meter of coated film.

The sensitometric results are reported in Table 1.

Comparative Example D

The procedure of Comparative Example A was repeated, except that during addition of coating finals, 19.76 grams of HP was added per one mole of silver, corresponding to 779 mg of compound per square meter of coated film.

The sensitometric results are reported in Table 1.

Comparative Example E

The procedure of Comparative Example A was repeated, except that during addition of coating finals, 2.29 grams of hydroquinone disulfonic acid potassium salt (2,5-dihydroxy-1,4.benzenedisulfonic acid dipotassium salt, hereinafter abbreviated "HQDS") was added per one mole of silver, corresponding to 90 mg of compound per square meter of coated film.

The sensitometric results are reported in Table 1.

Comparative Example F

The procedure of Comparative Example A was repeated, except that during addition of coating finals, 4.71 grams of HQDS was added per one mole of silver, corresponding to 186 mg of compound per square meter of coated film.

The sensitometric results are reported in Table 1.

Comparative Example G

The procedure of Comparative Example A was repeated, except that during addition of coating finals, 7.61 grams of HQDS was added per one mole of silver, corresponding to 300 mg of compound per square meter of coated film.

The sensitometric results are reported in Table 1.

Example 1

The procedure of Comparative Example A was repeated, except that during addition of coating finals, 2.29 grams of HQDS and 6.32 grams of HP were added per one mole of silver, corresponding to 90 mg and 249 mg per square meter of coated film, respectively.

The sensitometric results are reported in Table 1.

Example 2

The procedure of Comparative Example A was repeated, except that during addition of coating finals, 4.71 grams of HQDS and 13.44 grams of HP were added per one mole of silver, corresponding to 186 mg and 529 mg per square meter of coated film, respectively.

The sensitometric results are reported in Table 1.

Example 3

The procedure of Comparative Example A was repeated, except that during addition of coating finals, 7.61 grams of HQDS and 19.76 grams of HP were added per one mole of silver, corresponding to 300 mg and 779 mg per square meter of coated film, respectively.

The sensitometric results are reported in Table 1.

TABLE 1

| Sample | Compound | mg/m$^2$ | Dmin | Speed | Speed/Dmin |
|---|---|---|---|---|---|
| Comp. Ex. A | — | — | 0.209 | 2.312 | 11.06 |
| Comp. Ex. B | HP | 249 | 0.202 | 2.321 | 11.49 |
| Comp. Ex. C | HP | 529 | 0.197 | 2.337 | 11.86 |
| Comp. Ex. D | HP | 779 | 0.196 | 2.361 | 12.05 |
| Comp. Ex. E | HQDS | 90 | 0.202 | 2.339 | 11.58 |
| Comp. Ex. F | HQDS | 186 | 0.200 | 2.324 | 11.62 |
| Comp. Ex. G | HQDS | 300 | 0.196 | 2.322 | 11.85 |
| Ex. 1 | HQDS + HP | 90 + 249 | 0.195 | 2.326 | 11.93 |
| Ex. 2 | HQDS + HP | 186 + 529 | 0.191 | 2.366 | 12.23 |
| Ex. 3 | HQDS + HP | 300 + 779 | 0.186 | 2.334 | 12.55 |

The results of Examples 1–3 of the present invention clearly showed that the association of a polysaccharide derivative with an aryl compound, like HQDS, strongly reduced the Dmin of the final element together with increasing the speed. The association between a polysaccharide derivative and an aryl compound like HQDS demonstrated a synergistic effect as compared to Comparative Examples B–D (containing only a polysaccharide derivative) and Comparative Examples E–G (containing only an aryl compound).

Accordingly, the photographic elements of the present invention comprising a silver halide emulsion containing a polysaccharide derivative and an aryl compound showed an improved speed to Dmin ratio.

Comparative Examples H–N and Examples 4–6

The preparation, exposure and processing of Comparative Examples H–N and Examples 4–6 were identical to those of Comparative Examples A–G and Examples 1–3, respectively, but the fresh film samples were subjected to stress incubation for 10 days at 50° before being subjected to exposure.

The sensitometric results are reported in Table 2.

TABLE 2

| Sample | Compound | mg/m$^2$ | Dmin | Speed | Speed/Dmin |
|---|---|---|---|---|---|
| Comp. Ex. H | — | — | 0.209 | 2.312 | 11.06 |
| Comp. Ex. I | HP | 249 | 0.204 | 2.320 | 11.37 |
| Comp. Ex. J | HP | 529 | 0.199 | 2.329 | 11.70 |
| Comp. Ex. K | HP | 779 | 0.200 | 2.355 | 11.78 |
| Comp. Ex. L | HQDS | 90 | 0.206 | 2.345 | 11.38 |
| Comp. Ex. M | HQDS | 186 | 0.202 | 2.350 | 11.63 |
| Comp. Ex. N | HQDS | 300 | 0.198 | 2.346 | 11.85 |
| Ex. 4 | HQDS + HP | 90 + 249 | 0.194 | 2.330 | 12.01 |
| Ex. 5 | HQDS + HP | 186 + 529 | 0.193 | 2.348 | 12.17 |
| Ex. 6 | HQDS + HP | 300 + 779 | 0.189 | 2.345 | 12.41 |

Comparative Examples O–W and Examples 7–11

Comparative Example O was prepared as in Comparative Example A. Comparative Examples P–W were prepared as Comparative Example A, except that during addition of coating finals, various amounts of polysaccharide derivatives and HQDS were added according as shown in Table 3 below. The exposure and processing methods of the samples were identical to those of Comparative Example A and the results are summarized in Table 3.

TABLE 3

| Sample | Compound | Class | mg/m$^2$ | Dmin | Speed | Speed/Dmin |
|---|---|---|---|---|---|---|
| Comp. Ex. O | — | — | — | 0.209 | 2.312 | 11.06 |
| Comp. Ex. P | HQDS | Aryl compound | 186 | 0.202 | 2.325 | 11.51 |

TABLE 3-continued

| Sample | Compound | Class | mg/m$^2$ | Dmin | Speed | Speed/Dmin |
|---|---|---|---|---|---|---|
| Comp. Ex. Q | P516 | Hyd P MW 10,000 | 530 | 0.199 | 2.339 | 11.75 |
| Comp. Ex. R | P517 | Hyd P MW 6,000 | 530 | 0.195 | 2.355 | 12.08 |
| Comp. Ex. S | P518 | Hyd P MW 13,000 | 530 | 0.196 | 2.363 | 12.06 |
| Comp. Ex. T | P519 | No Hyd P MW 13,000 | 530 | 0.197 | 2.355 | 11.95 |
| Comp. Ex. U | P520 | No Hyd P MW 20,000 | 530 | 0.200 | 2.370 | 11.85 |
| Comp. Ex. V | HP | Hyd P MW 1,300 | 530 | 0.197 | 2.337 | 11.86 |
| Ex. 7 | HQDS + P516 | As above | 186 + 530 | 0.189 | 2.325 | 12.30 |
| Ex. 8 | HQDS + P517 | As above | 186 + 530 | 0.189 | 2.335 | 12.35 |
| Comp. Ex. W | HQDS + P518 | As above | 186 + 530 | 0.192 | 2.322 | 12.09 |
| Ex. 9 | HQDS + P519 | As above | 186 + 530 | 0.193 | 2.337 | 12.11 |
| Ex. 10 | HQDS + P520 | As above | 186 + 530 | 0.190 | 2.337 | 12.30 |
| Ex. 11 | HQDS + HP | As above | 186 + 530 | 0.191 | 2.336 | 12.23 |

Hyd P = Hydrogenated polysaccharide
No Hyd P = Non-hydrogenated polysaccharide

P516–P520 are polysaccharides commercially available from Roquette, Lille, France, having the characteristics and molecular weight indicated in Table 3.

The data in Table 3 demonstrates the synergistic effect of the present invention. Hydrogenated polysaccharides having a MW equal to or lower than 10,000 (P516, P517 and POLYSORB), when combined with HQDS, gave a strong reduction of Dmin without negatively affecting the speed so considerably increasing the speed to Dmin ratio. Similar results are obtained with non-hydrogenated having a MW higher than 10,000. On the other hand, compound P518 (hydrogenated polysaccharide having a MW higher than 10,000) did not show a similar synergistic effect when used in combination with HQDS.

The complete disclosures of all patents, patent applications, and publications are incorporated herein by reference as if individually incorporated. Various modifications and alterations of this invention will become apparent to those skilled in the art without departing from the scope and spirit of this invention, and it should be understood that this invention is not to be unduly limited to the illustrative embodiments set forth herein.

What is claimed is:

1. A process for the manufacturing of a silver halide photographic element comprising the steps of:

(i) preparing a silver halide emulsion, (ii) sensitizing said silver halide emulsion by means of a chemical and optical sensitization method, and (iii) coating said silver halide emulsion onto a support, wherein said process is characterized in that said process further comprises the step of adding to said silver halide emulsion (1) an aryl compound having at least two hydroxyl groups and at least one additional substituent selected from the group consisting of a sulfonic group, an alkali metal sulfonate group, a hydroxyl group, a carboxy group, and a hydroxymethyl group, and (2) a polyhydroxyalkyl derivative selected from the group consisting of non-hydrogenated polysaccharides having an average molecular weight higher than 10,000 and hydrogenated polysaccharides having an average molecular weight equal to or lower than 10,000.

2. The process according to claim 1, wherein said aryl compound is represented by the following formula:

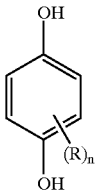

wherein R is a sulfonic group, an alkali metal sulfonate group, a hydroxyl group, a carboxy group or a hydroxymethyl group, and n is an integer of from 1 to 4.

3. The process according to claim 1, wherein said hydrogenated polysaccharides have an average molecular weight lower than 8,000.

4. The process according to claim 1, wherein said aryl compound is added in an amount lower than 30 grams per mole of silver and said polyhydroxyalkyl derivative is added in an amount lower than 50 grams per mole of silver.

5. The process according to claim 1, wherein said aryl compound is added in an amount of from 2 to 8 grams per mole of silver and said polyhydroxyalkyl derivative is added in an amount of from 2 to 20 grams per mole of silver.

6. A process for the manufacturing of a silver halide photographic element comprising:

(i) preparing a silver halide emulsion;

(ii) sensitizing the silver halide emulsion by means of both chemical sensitization and optical sensitization; and (iii) coating the silver halide emulsion onto a support, wherein the process further comprises the step of adding to the silver halide emulsion before it is coated onto the support both:

a) an aryl compound having at least two hydroxyl groups and at least one additional substituent selected from the group consisting of a sulfonic group, an alkali metal sulfonate group, a hydroxyl group, a carboxy group, and a hyroxymethyl group, and b) a polyhydroxyalkyl derivative comprising a non-hydrogenated polysachharide having an average molecular weight higher than 10,000.

7. A silver halide photographic element comprising at least one silver halide emulsion layer coated on a support base, wherein said silver halide emulsion layer comprises a combination of (1) an aryl compound having at least two hydroxyl groups and at least one additional substituent represented by a sulfonic group, an alkali metal sulfonate group, a hydroxyl group, a carboxy group and a hydroxymethyl group, and (2) a polyhydroxyalkyl derivative selected from the group consisting of non-hydrogenated polysaccharides having an average molecular weight higher than 10,000 and hydrogenated polysaccharides having an average molecular weight equal to or lower than 10,000.

8. The element according to claim 7, wherein said aryl compound is represented by the following formula:

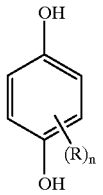

wherein R is a sulfonic group, an alkali metal sulfonate group, a hydroxyl group, a carboxy group, or a hydroxymethyl group, and n is an integer of from 1 to 4.

9. The photographic element according to claim 7, wherein said aryl compound is added in an amount of from 2 to 8 grams per mole of silver and said polyhydroxyalkyl derivative is added in an amount of from 2 to 20 grams per mole of silver.

10. A process for increasing the speed to Dmin ratio of a light-sensitive silver halide element comprising adding both (1) an aryl compound having at least two hydroxyl groups and at least one additional substituent represented by a sulfonic group, an alkali metal sulfonate group, a hydroxyl group, a carboxy group and a hydroxymethyl group, and (2) a polyhydroxyalkyl derivative selected from the group consisting of non-hydrogenated polysaccharides having an average molecular weight higher than 10,000 and hydrogenated polysaccharides having an average molecular weight equal to or lower than 10,000 to a chemically and optically sensitized light-sensitive silver halide element.

11. The process of claim 10 wherein the non-hydrogenated polysaccharide has an average molecular weight higher than 15,000.

* * * * *

UNITED STATES PATENT AND TRADEMARK OFFICE

CERTIFICATE OF CORRECTION

PATENT NO. : 6,235,461 B1 
DATED : May 22, 2001
INVENTOR(S) : Alain Dominique M. Sismondi and Marco Serafini It is certified that error appears in the above-identified patent and that said Letters Patent is hereby corrected as shown below:

Title page,
Item [73], Assignee, please delete name of Assignee's country "(IT)" and replace with -- (PT), Portugal --

Signed and Sealed this

Twenty-fourth Day of December, 2002

JAMES E. ROGAN
*Director of the United States Patent and Trademark Office*